US005669135A

United States Patent [19]

Verhille

[11] Patent Number: 5,669,135

[45] Date of Patent: Sep. 23, 1997

[54] CONNECTOR SUPPORT FOR HARNESS MAKING MACHINE

[75] Inventor: Michel Maurice Bernard Verhille, Peynier, France

[73] Assignee: The Whitaker Corporation, Wilmington, Del.

[21] Appl. No.: 643,659

[22] Filed: May 6, 1996

[30] Foreign Application Priority Data

May 18, 1995 [FR] France ..... 95 05941

[51] Int. Cl.[6] ..... H01R 43/00

[52] U.S. Cl. ..... 29/760; 29/33 M; 29/747; 29/748; 269/903

[58] Field of Search ..... 29/33 M, 747, 29/748, 755, 759, 760, 842; 269/903

[56] References Cited

U.S. PATENT DOCUMENTS

| | | | |
|---|---|---|---|
| 4,650,391 | 3/1987 | Adlon et al. | 269/903 X |
| 4,967,470 | 11/1990 | Folk | 29/747 |
| 5,208,977 | 5/1993 | Ricard | 29/33 M X |
| 5,457,875 | 10/1995 | Ohta et al. | 29/760 X |
| 5,575,058 | 11/1996 | Nakamura et al. | 29/748 |
| 5,581,873 | 12/1996 | Okura et al. | 29/755 X |
| 5,588,206 | 12/1996 | Maejima et al. | 29/748 X |

FOREIGN PATENT DOCUMENTS

| | | | |
|---|---|---|---|
| 534822 | 3/1993 | European Pat. Off. | 29/748 |

OTHER PUBLICATIONS

"Fixture For Holding An Array of Spring Connectors" IBM Technical Disclosure Bulletin, vol. 28, No. 9, Feb. 1986, pp. 3803–3804.

*Primary Examiner*—Peter Vo
*Attorney, Agent, or Firm*—D. Nina

[57] ABSTRACT

A connector support for a harness making machine comprises a clip member pivotly mounted to a base structure. The clip member comprises a rigid bar and a spring extending at an angle with respect to the bar. The bar and spring capture orthogonal surfaces of a connector against a connector receiving face and a lip of the base structure. A lower corner of the connector can be clipped behind the lip by biasing the connector against the bar which thus pivots causing the spring to push the connector down against the receiving face. This design enables easy and rapid mounting of a connector to the support structure, as well as easy ejection of the connector therefrom by an ejector pin. The support is for camming the connector on a conveyor system of a harness making machine for processing such as block loading etc.

7 Claims, 3 Drawing Sheets

CONNECTOR SUPPORT FOR HARNESS MAKING MACHINE

BACKGROUND OF THE INVENTION

1. Field of the Invention

This invention relates to a support for supporting and positioning connector housings in a harness making machine, for example for transporting the housing to processing stations such as terminal loading stations.

2. Description of the Prior Art

In U.S. Pat. No. 5,208,977 a harness making machine for fully automated production of harnesses is disclosed. The machine comprises a linear conveyor system that transports wire ends to various processing stations. One of the stations is for inserting terminated wire ends into cavities of connector housings. The connector housings are supported on pallets that enable transportation and positioning of the connector housings for terminal loading. It is known to provide the pallets with cavities that receive the connector housings therein, the pallet comprising a resilient latch for securely fixing the connector housing to the pallet. A pallet for holding connector housings is also described in European Patent Application No. 564 536.

The connector supports in the above patents are not designed for automated release of the connectors from the support, for example when the processing of the connector is complete. Furthermore, it is a continuous desire to simplify the connector holding device, not only for reducing the cost of producing the connector holders, but more particularly to enhance the ease of mounting terminal to the connector holder and removing from the connector holder. In the case of palettes with cutouts for receiving the connectors therein, it is sometimes difficult to reliably hold the connector in position whilst nevertheless enabling rapid insertion of the connector to the pallet and rapid removal therefrom, because the connector is set within the cutout and therefore relatively difficult to access.

SUMMARY OF THE INVENTION

It is therefore an object of this invention to provide a connector support for transporting connector parts in a harness making machine, that allows rapid and reliable positioning of the connector parts thereon.

It is a further object of this invention to provide a connector support for a harness making machine that enables automatic ejection of the connector from the support.

Objects of this invention have been achieved by providing a connector support for a harness making machine, the support comprising a base structure having a face against which a connector can be supported, and a clip member pivotly mounted to the base structure, the clip member comprising a bar and a spring securely attached together and extending at an angle greater than zero with respect to each other from their attached end to free ends respectively, where the attached end is proximate the pivot axis. The free end of the bar is adapted to abut against a second surface of a connector, and the spring is for biasing against a third surface of the connector, the spring member being positioned in a spaced manner above and substantially opposed to the connector receiving face of the base structure. In an advantageous embodiment, a lip extends from an edge of the connector receiving face to capture a corner of the connector remote from the free end of the bar such that the connector can be held to the support by being captured between the spring and the connector receiving face on the one hand, and by the bar and the lip on the other hand.

Other advantageous aspects of the invention will be apparent from the following description and the claims.

FIGS. *5a–5f* are successive side views showing assembly and then removal of a connector housing from a connector support according to this invention.

DETAILED DESCRIPTION OF THE PREFERRED EMBODIMENT

Figure 1:
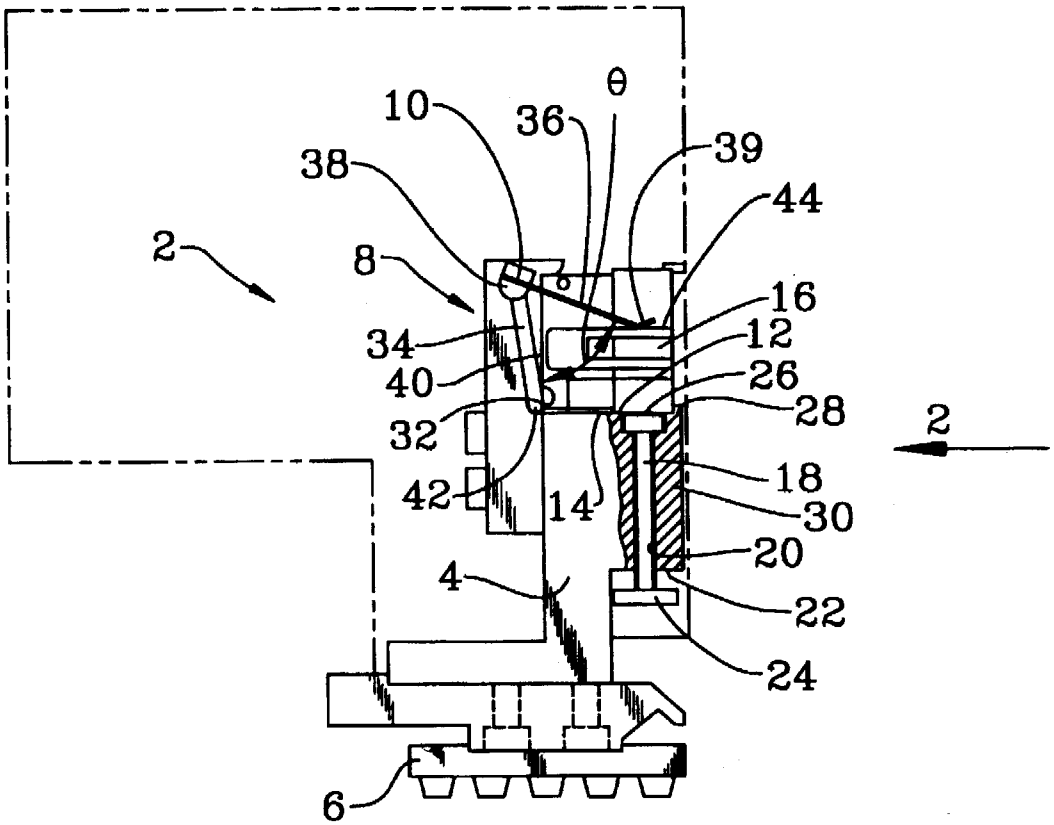
FIG. 1 is a side view of a connector support according to this invention, gripping a connector housing.
Figure 2:
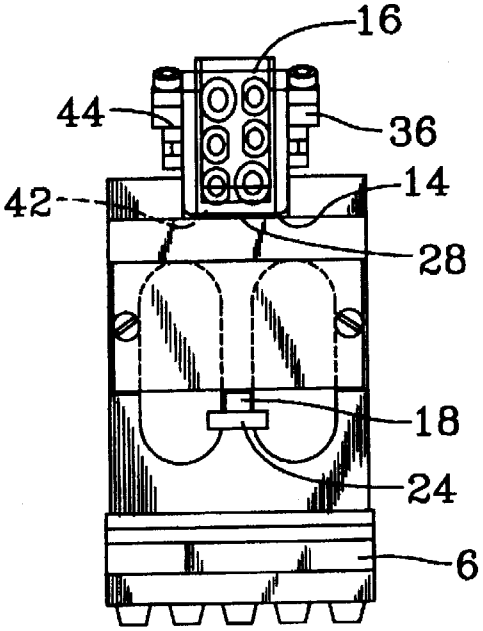
FIG. 2 is a view in the direction of arrow 2 of FIG. 1.

Referring to FIGS. 1 and 2, a connector support 2 comprises a base structure 4 mounted on a conveyor support plate 6, further comprising a clip member 8 pivotly mounted about a rotation axis 10 to the base structure 4. The base structure 4 comprises a connector receiving surface 12 against which a first surface 14 of a connector 16 can be mounted. An ejector pin 18 is mounted in a bore 20 of the base structure that extends from the connector receiving face into the base structure to a lower face 22. The ejector pin 18 has a lower end 24 extending below the lower face 22 of the base structure. An upper end 26 of the ejector pin 18 is positioned proximate the first surface 14 of the connector when assembled thereto. The ejector pin 18 is vertically slidable such that the upper end 26 can bias the connector first surface 14 away from the connector receiving face 12 of the structure.

The connector receiving face 12 extends between a lip 28 protruding from the face 12 and positioned proximate a front face 30 of the structure, to a rear connector receiving face 32 proximate the clip member 8. The clip member 8 comprises a substantially rigid bar 34 and a spring 36 in the shape of a cantilever beam extending from an attachment end 38 where it is rigidly attached to the bar 34, to a free end 40. The bar 34 extends from the attachment end 38 to a free end 42 positioned proximate the connector receiving face 12. The bar 34 is in this embodiment substantially U-shaped where the free end 42 comprises a transverse bar joining lateral arms of the U. The free end 42 also constitutes an abutment end for abutment against a second surface 39 of the connector 16 orthogonal to the first surface 14. The bar 34 and spring 36 are positioned at an angle $\Theta$ with respect to each other, where the spring 36 is for abutment against a third surface 44 of the connector 16 substantially parallel to the first surface 14.

Figure 5D:
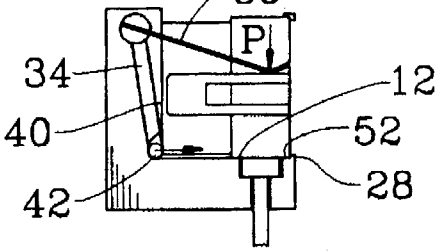

Assembly of the connector 16 to the connector support 2 will now be described with reference to FIGS. *5a–5d*. Initially, as shown in FIG. *5a*, the connector is advanced over the lip 28 such that the spring free end 39 is biased over onto the third surface 44 of the connector as shown in FIG. *5b*. The biasing of the spring is enabled by pivoting of the clip member 8 about the axis 10. Insertion is continued until the connector rear face 40 abuts the bar 34 at the abutment end 42 as shown in FIG. *5c*. In this position, the connector 16 abuts both the spring and the bar and is seated on top of the lip 28. By applying a force F on a wire receiving face 50 of the connector spaced apart and opposed from the rear face 40, the rear face 40 is biased with a force F against the bar 34. The latter tends to cause rotation of the clip member 8 about the axis 10, but due to the tilt of the connector 16 because it is seated on top of the lip 28, the spring 36 is resiliently biased apart from the bar 34 thereby applying pressure P against the third surface 44 of the connector. The latter thus causes a lower corner 52 of the connector to clip behind the lip 28 as shown in FIG. 5*d*. In this position, the connector 16 is securely help to the support 2 by action of the spring 36 biasing the connector towards the connector receiving face 12, and orthogonally thereto, the connector is captured between the lip 28 and the bar abutment end 42. The above procedure thus allows easy and rapid mounting of the connector 16 to the support without the requirement for particularly accurate guiding by the operator, due to the pivotable clip 8 providing the guiding function.

Figure 5E:
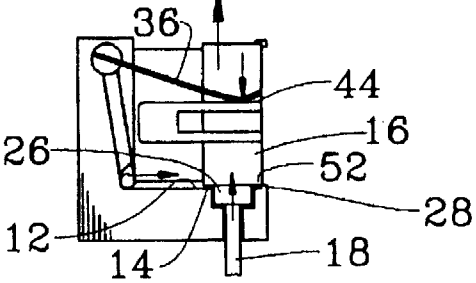
Figure 5F:
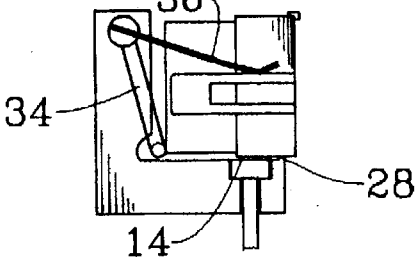
Figure 5A:
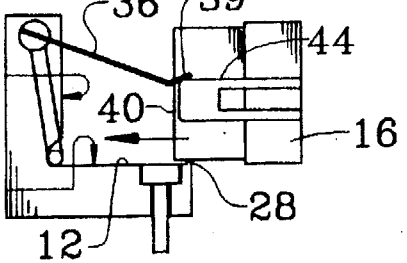
Figure 5B:
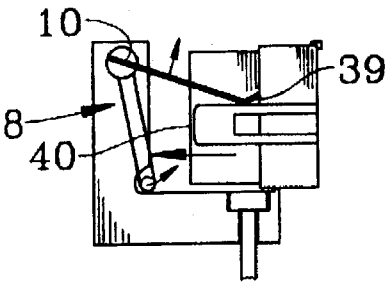
Figure 5C:
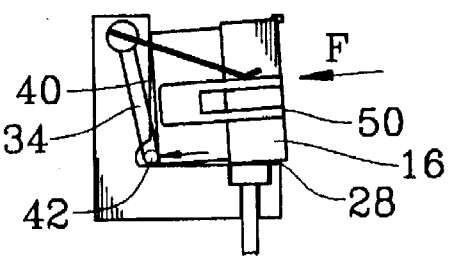

The connector 16 can be removed from the support by biasing the ejector pin 18 beyond the connector receiving face 12 in opposition to the spring force of the spring 36, until the corner 52 disengages from the lip 28 as shown in FIG. 5*e*. Due to the biased spring, the bar 34 rotates to eject the connector 16 over the lip 28 as shown in FIG. 5*f*, where the connector can then be simply removed from the support. Actuation of the ejector 18 can be done automatically by an ejection station that simply depresses the end 24 towards the lower face 22 of the base structure.

Figure 3:
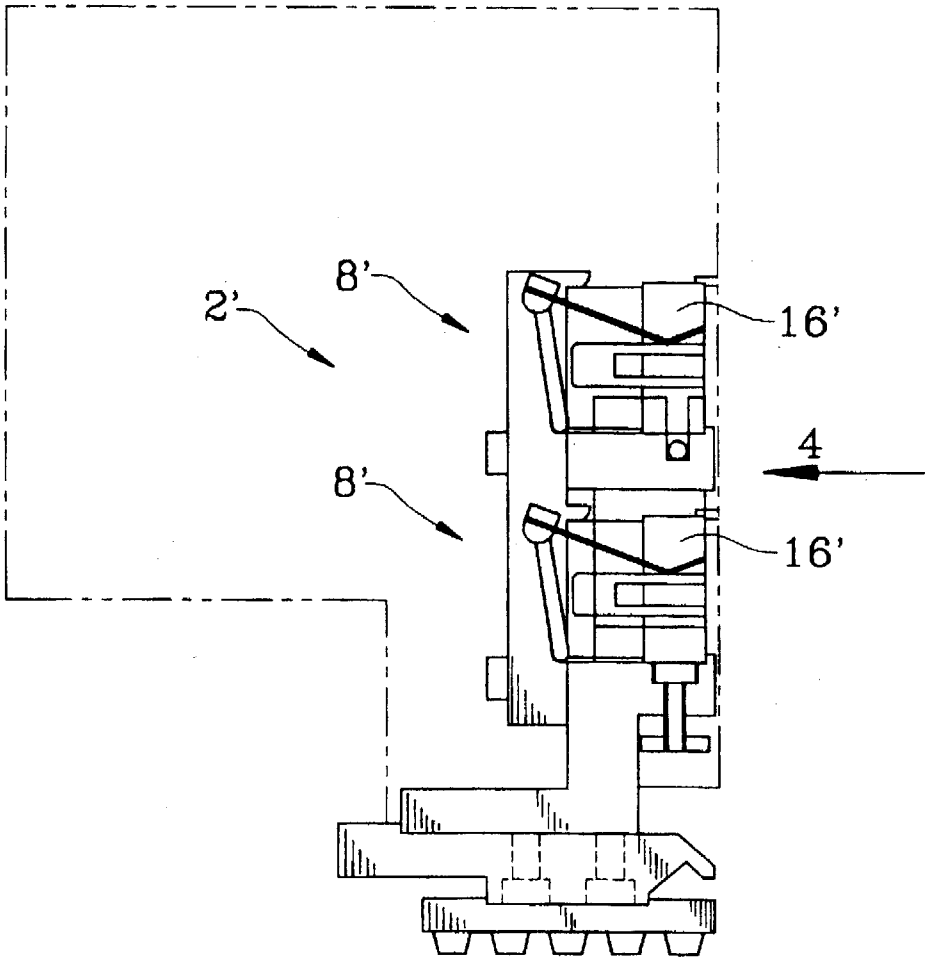
FIG. 3 is a side view of another embodiment of a connector support according to this invention, the connector support for supporting a plurality of connector housings.
Figure 4:
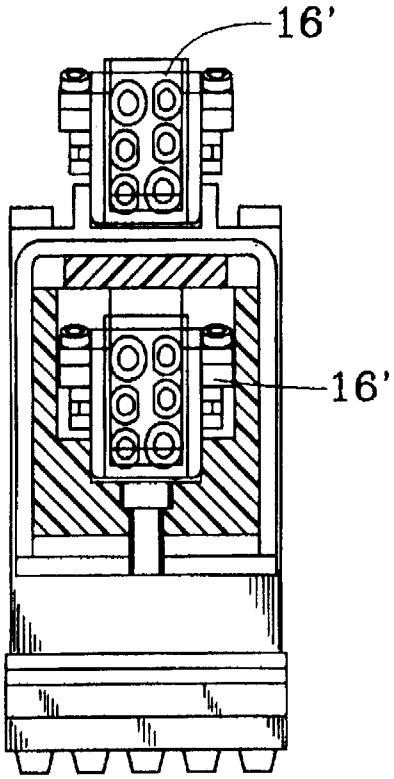
FIG. 4 is a view in the direction of arrow 4 of FIG. 3.

In FIGS. 3 and 4, a connector holder 2' comprises a pair of clip members 8' that are similar to the clip member 8 in the embodiment of FIG. 1. FIGS. 3 and 4 simply illustrate that a number of connectors can be supported on a single support member if desired.

The connector support 2 can be transported along a conveyor system to various processing stations of a harness making machine, where the conveyor grips the conveyor support plate 6. The conveyor support plate 6 serves to accurately position the connector support 2 with respect to the conveyor system in a similar manner to conventional support structures of harness making machines.

Advantageously therefore, easy and rapid assembly of a connector housing to a support is provided as the connector does not need to be accurately inserted into a cutout or cavity in a pallet. Furthermore, easy, rapid and automatable ejection is enabled by this design.

I claim:

1. A connector support for transporting and holding a connector in a harness making machine, the connector support comprising a support plate for transporting the connector support on a conveyor system, a base structure, and a connector holding means, wherein the connector holding means comprises a connector receiving face of the base structure, and a clip pivotally mounted about a pivot axis to the base structure, the clip comprising a bar and a spring attached together proximate the pivot axis, where the bar is adapted to abut a second surface of the connector, and the spring adapted to resiliently bias against a third surface of the connector transverse to the second surface, thereby biasing a first surface of the connector against the connector receiving face, the first surface being substantially opposed to the third surface.

2. The connector support of claim 1 wherein the base structure comprises a lip protruding from the connector receiving face remote from the bar and engageable with a corner of the connector for gripping the connector between the bar and the lip.

3. The connector support of claim 2 wherein the spring is in the shape of a cantilever beam extending from an attachment end where it is rigidly attached to the bar, to a free end that is biasable against the connector.

4. The connector support of claim 3 wherein the bar extends from the attachment end to a free end abuttable against the connector, where the attachment end is at the pivot axis.

5. The connector support of claim 1 wherein the spring and bar extend with respect to each other at an angle less than 90°.

6. The connector support of claim 1 wherein the bar, spring, and connector receiving face are adapted to abut second, third and first surfaces respectively of the connector, where the first and third surfaces are substantially parallel and opposed, and the second surface extends substantially orthogonally between the first and third surfaces.

7. The connector support of claim 1 wherein an ejector pin is slidably mounted in a cavity extending from and below the connector receiving face, the ejector pin having an upper end positioned proximate the receiving face and movable therebeyond when actuated for biasing the connector first surface beyond the lip for ejection thereof from the connector support.

* * * * *